US007942085B2

(12) United States Patent
Hsieh

(10) Patent No.: US 7,942,085 B2
(45) Date of Patent: May 17, 2011

(54) DOUBLE-FULCRUM TORQUE WRENCH

(76) Inventor: Chih-Ching Hsieh, Yuan (TW)

( * ) Notice: Subject to any disclaimer, the term of this patent is extended or adjusted under 35 U.S.C. 154(b) by 0 days.

(21) Appl. No.: 11/378,328

(22) Filed: Mar. 20, 2006

(65) Prior Publication Data

US 2010/0147118 A1 Jun. 17, 2010

(51) Int. Cl.
*B25B 23/159* (2006.01)
*B25B 23/142* (2006.01)

(52) U.S. Cl. ..... 81/478; 81/477

(58) Field of Classification Search ..... 81/467, 81/481, 483, 468, 472, 476, 477, 478, 479; 73/862.21, 862.22, 862.23, 862.26
See application file for complete search history.

(56) References Cited

U.S. PATENT DOCUMENTS

| | | | | |
|---|---|---|---|---|
| 2,715,333 | A * | 8/1955 | Larson | 73/862.21 |
| 3,596,543 | A * | 8/1971 | Green | 81/482 |
| 4,290,329 | A * | 9/1981 | Green | 81/477 |
| 4,532,836 | A * | 8/1985 | Grabovac | 81/483 |
| 4,732,062 | A * | 3/1988 | Grabovac et al. | 81/483 |
| 5,859,371 | A * | 1/1999 | Hsieh | 73/862.23 |
| 6,109,150 | A * | 8/2000 | Saccomanno, III | 81/478 |
| 6,119,562 | A * | 9/2000 | Jenkins | 81/479 |
| 6,463,834 | B2 * | 10/2002 | Kemp et al. | 81/483 |
| 6,722,235 | B2 * | 4/2004 | Hsieh | 81/478 |
| 7,069,827 | B1 * | 7/2006 | Hsieh | 81/476 |
| 7,082,865 | B2 * | 8/2006 | Reynertson, Jr. | 81/479 |
| 7,469,619 | B2 * | 12/2008 | Anjanappa et al. | 81/479 |
| 2001/0022121 | A1 * | 9/2001 | Gambarini | 81/479 |
| 2003/0159552 | A1 * | 8/2003 | Hsieh | 81/478 |
| 2004/0255733 | A1 * | 12/2004 | Reynertson, Jr. | 81/467 |
| 2005/0072278 | A1 * | 4/2005 | Cutler et al. | 81/467 |
| 2005/0150335 | A1 * | 7/2005 | Crane | 81/467 |

* cited by examiner

*Primary Examiner* — David B Thomas
(74) *Attorney, Agent, or Firm* — Guice Patents PLLC

(57) ABSTRACT

A double-fulcrum torque wrench including a tubular body, a head section for fitting with a socket or a screwing member and a flexible mechanism including a flexible section. The flexible mechanism is connected with a rear end of the head section and disposed in the tubular body. The head section protrudes from a front end of the tubular body. When a wrenching force is applied to the wrench, the flexible section of the flexible mechanism is flexible. The head section and the flexible mechanism are connected with the tubular body via two fulcrums and the flexible section is positioned between the two fulcrums. By means of the double-fulcrum design, the action force at the force application end of the wrench is equal to the action force at the resistance end. In addition, the flexure of the wrench and the actual wrenching torque applied to the wrench can be more accurately and sensitively measured.

10 Claims, 7 Drawing Sheets

DOUBLE-FULCRUM TORQUE WRENCH

BACKGROUND OF THE INVENTION

The present invention is related to a hand tool, and more particularly to a torque wrench in which the action force at the force application end of the wrench is equal to the action force at the resistance end. Even if the wrenching position of wrenching the wrench is varied, the action force at the force application end will still conform to the action force at the resistance end.

The existent torque wrenches can be divided into mechanical type wrenches and electronic type wrenches. A torque value can be set in a mechanical type wrench, in the case that the torque applied to the wrench exceeds the set value, an alarm such as a sound is emitted. An electronic type wrench is able to display the wrenching torque.

Both the mechanical type wrenches and electronic type wrenches have a common shortcoming, that is, the force applied to the wrench is unequal to the wrenching force acting on a socket or a screwing member.

FIG. 1 shows a conventional mechanical torque wrench 10 having a tubular body 12 and a bar body 13 disposed in one end of the tubular body 12. The bar body 13 is pivotally connected with a front end of the tubular body 12 via a pin 14. The front end of the bar body has a head section 15. When rotating the handle 16 of a rear end of the tubular body 12, the handle 16 drives a slide block 20 to move via an adjustment mechanism 18 so that a spring 22 resiliently abuts against a push block 24. A front end of the push block resiliently abuts against the rear end of the bar body 13. The resilient energy is right the set value of the wrench.

The head section 15 is fitted with a socket or a screwing member and then the wrench is wrenched to wrench the socket or the screwing member. When the wrenching force applied to the wrench is greater than the set value, the bar body 13 slips off from the push block 24 to emit a sound. This informs a user that the applied force exceeds the set value.

The above wrench is a single-fulcrum structure, that is, simply the pin 14 serves as the fulcrum 14 between the application force end (the handle) and the resisting force end (the head section) of the wrench. FIG. 2 shows the static state of such single-fulcrum structure. It can be known from the bending moment that the torque at the position of the applied force P is unequal to the torque at the fulcrum R. Therefore, the action forces at the resisting force end and at the application force end of the wrench are unequal. As a result, the wrenching force applied to the wrench is unequal to the wrenching force applied to a screwing member by the head section. FIGS. 2 and 3 respectively show diagrams of bending moment (M) and shear force (S) at different force application points.

Similarly, the conventional electronic torque wrench only has one fulcrum. The action force at the resisting force end is unequal to the action force at the application force end of the wrench. The displayed torque value is hardly true and reliable.

In addition, with respect to the single-fulcrum torque wrench, when the position of the wrench, to which the wrenching force is applied is varied, the position where maximum deformation takes place is also varied. However, the tension gauge of the electronic torque wrench for measuring the deformation is arranged in a fixed position; also, the slippage structure of the mechanical torque wrench is arranged in a fixed position, therefore, the measured position is often not the maximum deformation position. Accordingly, the result of the measurement is hardly true and accurate.

With respect to mechanical torque wrench, there is often a difference between the set torque value and the true wrenching force.

SUMMARY OF THE INVENTION

It is therefore a primary object of the present invention to provide a double-fulcrum torque wrench in which the action force at the force application end is always equal to the action force at the resistance end.

It is a further object of the present invention to provide the above torque wrench in which the actual wrenching torque applied to the wrench can be accurately, sensitively and truly measured and reflected.

The present invention can be best understood through the following description and accompanying drawings wherein:

DETAILED DESCRIPTION OF THE PREFERRED EMBODIMENTS

The present invention provides a double-fulcrum torque wrench. The torque of the wrench will not be affected by changing force application position of the wrench. The double-fulcrum torque wrench of the present invention can be a mechanical torque wrench or an electronic torque wrench.

Figure 4:
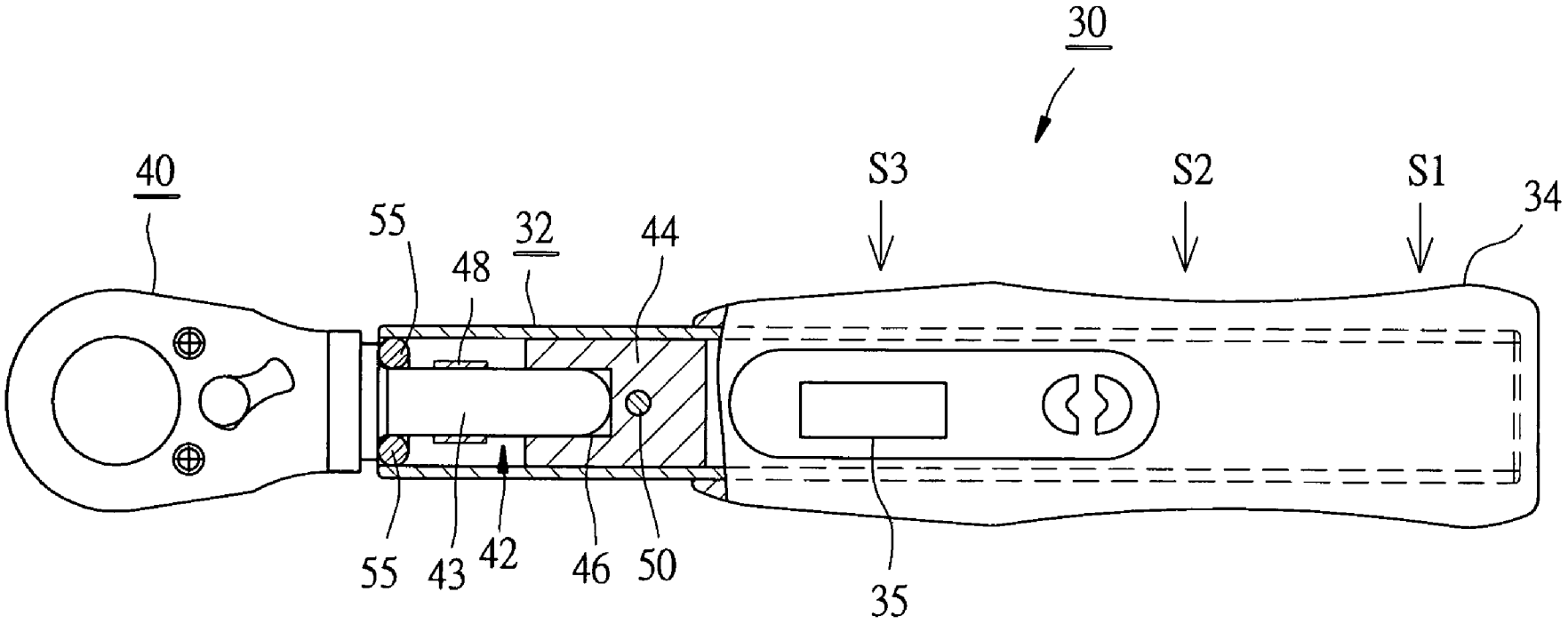
FIG. 4 is a top partially sectional view of a preferred embodiment of the present invention.
Figure 5:
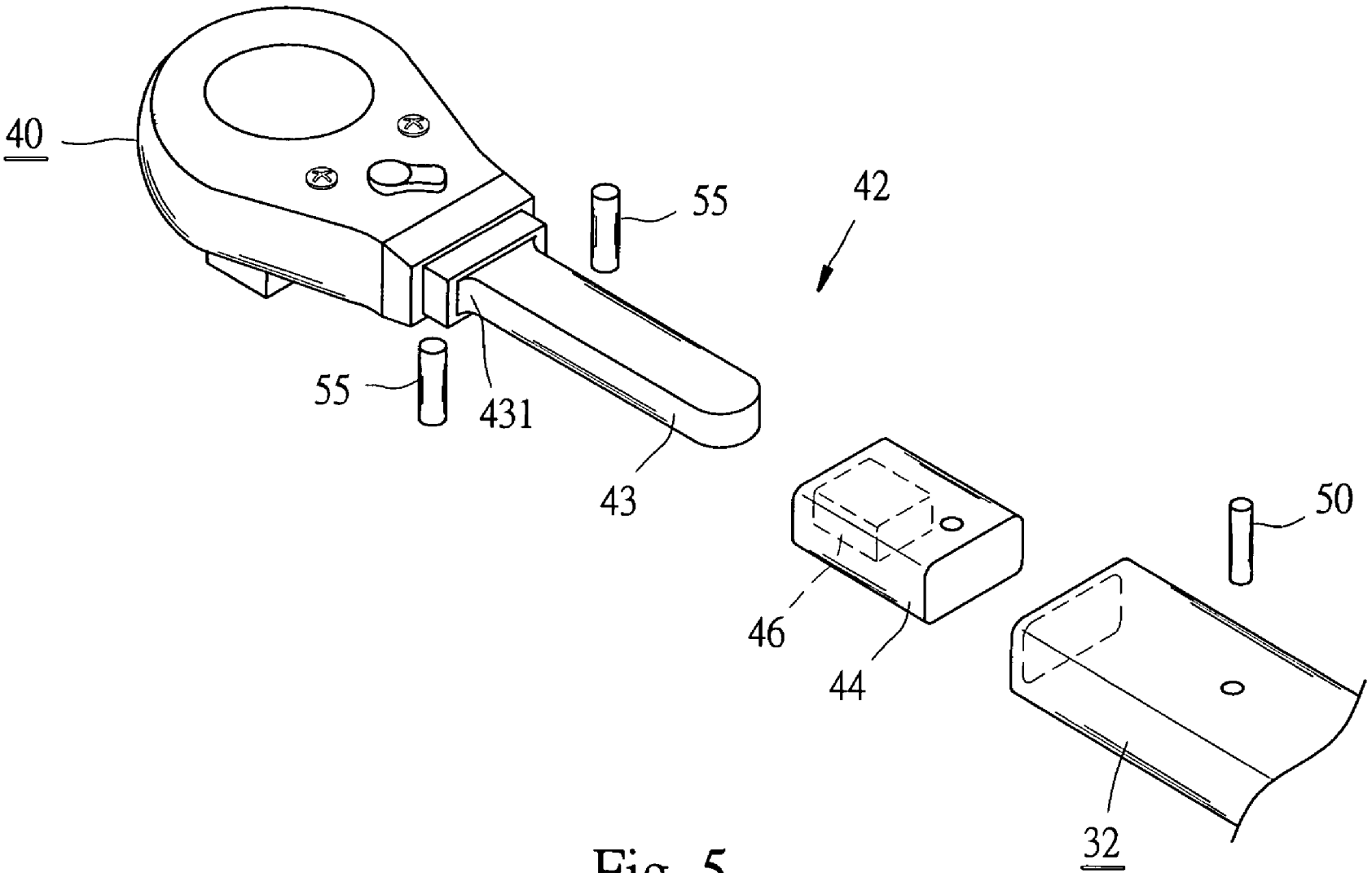
FIG. 5 is a partially perspective exploded view of the embodiment of FIG. 4.

Please refer to FIGS. 4 and 5. According to a preferred embodiment, the torque wrench 30 of the present invention is an electronic wrench.

The wrench 30 includes a tubular body 32 and a handle 34 fitted with a rear end of the tubular body 32. A head section 40 which is for fitting with a socket, a bolt or a nut. A flexible mechanism 42 is connected with a rear end of the head section 40. The flexible mechanism includes a flexible bar 43 and a jacket 44. The flexible bar 43 has a smaller width for flexion. The front end of the flexible bar 43 is connected with the head section 40. Two sides of a joint section between the flexible bar 43 and the head section 40 respectively serve as two locating points 431. The rear end of the flexible bar 43 is fitted into an insertion hole 46 of the jacket 44. The flexible bar is tightly fitted with the jacket without any gap. Therefore, they are deemed as an integrated body. The flexible mechanism 42 is mounted in the front end of the tubular body 32 with the head section 40 protruding from the tubular body 32.

A first insertion pin 50 is inserted through the tubular body 32 and the jacket 44 to locate the flexible mechanism 42. Two support pins 55 are respectively positioned at the locating points 431 of two sides of the flexible bar 43. The support pins 55 are tightly fitted between the inner wall of the tubular body 32 and the flexible bar 43 without any gap.

Figure 6:
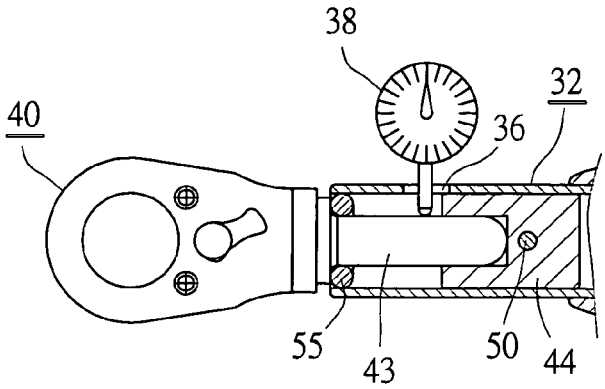
FIG. 6 shows that a meter is used to measure the curvature of the torque wrench for knowing the torque applied thereto.

When a force is applied to the handle 34 to operate the wrench 30, the flexible bar 43 will be flexed. By means of measuring the flexure of the flexible bar, the magnitude of the application force can be known. Referring to FIG. 4, for knowing that the applied torque, two sensing units 48 such as tension meters, strain gauges and piezoelectric switches can be attached to two sides of the flexible bar 43. By means of Wheatstone bridge, the torque value can be known and shown in a window 35 on the surface of the handle. Alternatively, as shown in FIG. 6, the tubular body 32 can be formed with a through hole 36 for a gauge 38 to measure the curvature of the flexible bar 43 and read the torque value.

Figure 7:
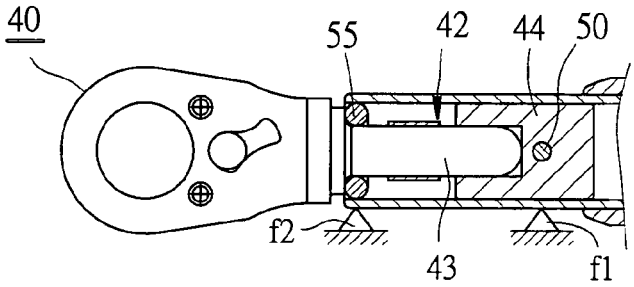
FIG. 7 shows that the wrench of FIG. 4 has two fulcrums.

FIG. 7 shows that the wrench 30 of the present invention has two fulcrums f1, f2. The first insertion pin 50 serves as the first fulcrum f1, while the support pins 55 serve as the second fulcrum f2. The flexible section (the flexible bar 43) of the flexible mechanism 42 is positioned between the two fulcrums.

Figure 8:
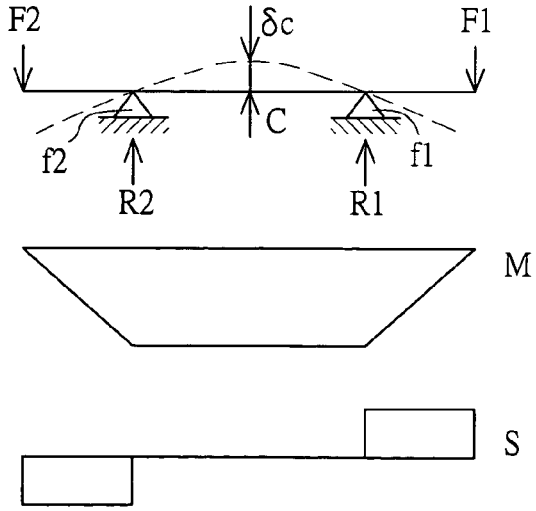
FIG. 8 shows diagrams of bending moment and shear force of the torque wrench of FIG. 4.

Referring to FIG. 8, by means of the double-fulcrum structure, when an action force F1 is applied to the handle 34 of the wrench, a corresponding action force F2 is applied to the head section 40. F1 is equal to F2. The diagram of bending moment of the double-fulcrum structure is a symmetrical diagram. Therefore, the action force at the force application end (the handle) is equal to the action force at the resistance end (the head section) of the wrench. Accordingly, no matter where the force is applied to the handle, for example, S1, S2 or S3 of FIG. 4, an equal action force is applied to the head section. Therefore, the operating force of a user can be truly reflected at the head section 40. Even if the force application position is varied, the action force at the force application end is equal to the action force at the resistance end.

In addition, due to the double-fulcrum design, no matter where the wrenching force is applied, the flexion always takes place between the two fulcrums f1, f2. The maximum strain $\delta c$ is positioned at the center C between the two fulcrums. Therefore, a most accurate measurement result is achievable by means of measuring the deformation of this section. The sensing units 48 or the gauge 38 is used to measure the deformation of this position C so that a most precise measurement result is obtained.

Figure 1:
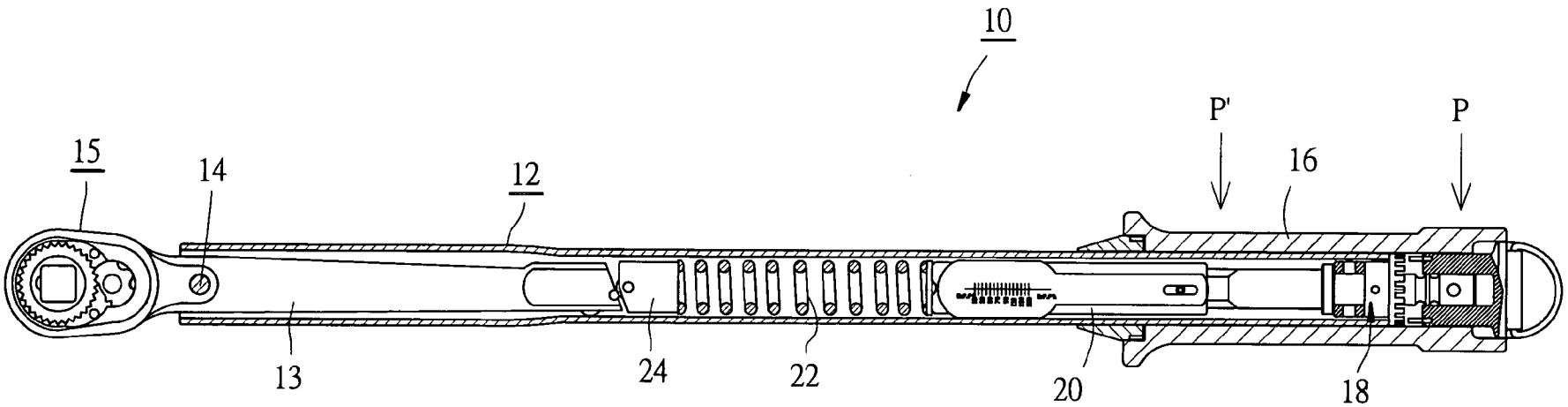
Fig. 1 PRIOR ART
FIG. 1 is a longitudinal sectional view of a conventional torque wrench.
Figure 2:
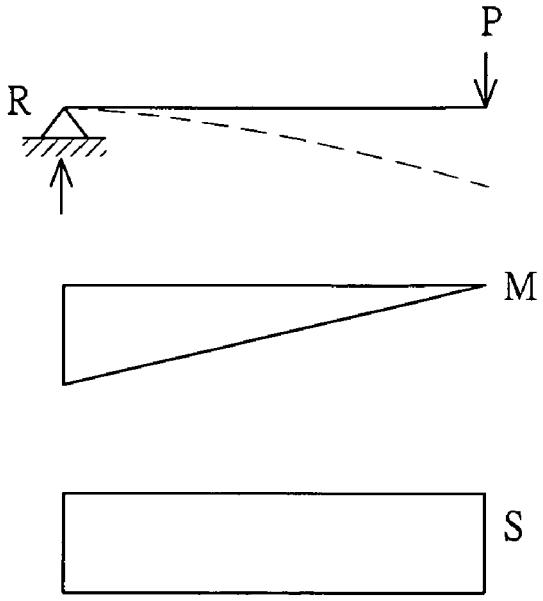
Fig. 2 PRIOR ART
FIGS. 2 and 3 respectively show diagrams of bending moment and shear force at different force application points of the conventional torque wrench.
Figure 3:
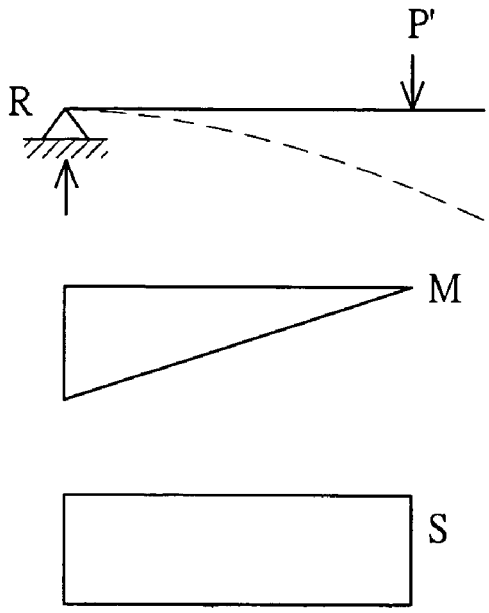
Fig. 3 PRIOR ART
Figure 9:
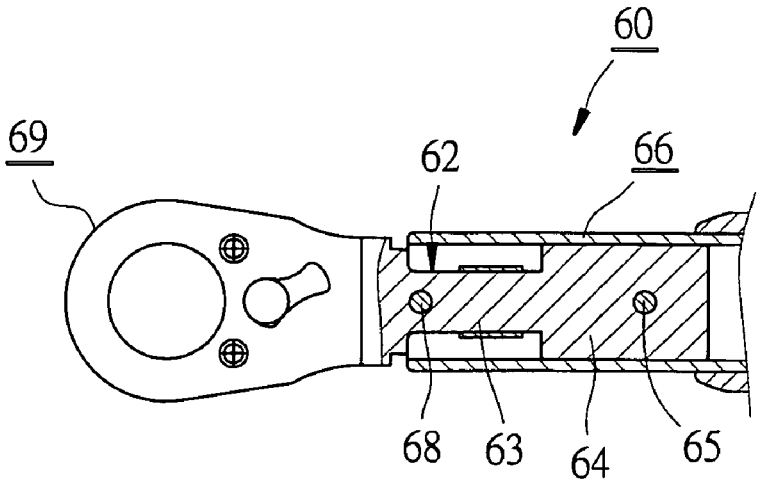
FIG. 9 is a top partially sectional view of another preferred embodiment of the present invention.

Referring to FIG. 9, the flexible bar 63 and the jacket 64 of the flexible mechanism 62 can be an integrated body. A pin 65 is inserted through the jacket 64 and the tubular body 66 to serve as the first fulcrum (rear fulcrum). A second insertion pin 68 is inserted through the front end of the flexible bar 63 and the tubular body 66 to serve as the second fulcrum (front fulcrum). Accordingly, each end of the flexible mechanism 62 has a fulcrum so that the action force at the force application end of the wrench is equal to the action force at the resistance end (head section 69).

Figure 10:
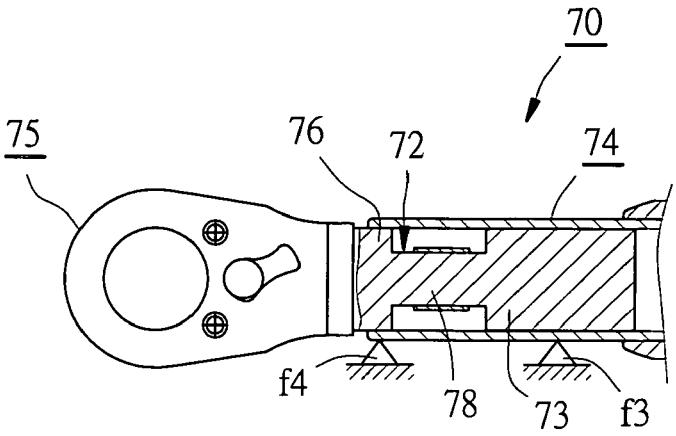
FIG. 10 is a top partially sectional view of still another preferred embodiment of the present invention.

FIG. 10 shows another embodiment of the wrench 70 of the present invention. The jacket 73 of the flexible mechanism 72 is tightly fixedly fitted in the tubular body 74. The rear end of the head section 75 has an insertion section 76 tightly inserted in the tubular body 74. The jacket 73 and the insertion section 76 respectively serve as the rear fulcrum f3 and front fulcrum f4. The flexible bar 78 is flexible between the two fulcrums.

Figure 11:
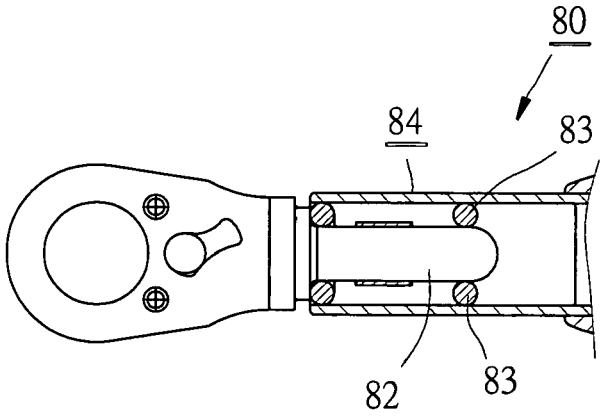
FIG. 11 is a top partially sectional view of still another preferred embodiment of the present invention.

FIG. 11 shows a wrench 80 in which two support pins 83 are disposed on two sides of the rear end of the flexible bar 82 to serve as the rear fulcrum. The tubular body 84, the support pins 83 and the flexible bar 82 are tightly fitted with each other. The front fulcrum of the flexible bar can be any of the above embodiments.

Figure 12:
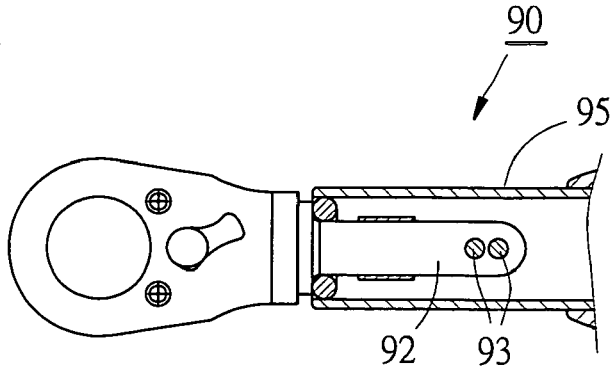
FIG. 12 is a top partially sectional view of still another preferred embodiment of the present invention.

FIG. 12 shows a wrench 90 in which one or two insertion pins 93 are inserted through the rear end of the flexible bar 92 and the tubular body 95 to serve as the rear fulcrum. The front fulcrum of the flexible bar can be any of the above embodiments.

It should be noted that the various aspects of the front and rear fulcrums of the above embodiments can be combined as desired. For example, the rear fulcrum of FIG. 9 and the front fulcrum of FIG. 4 can be combined. Alternatively, the rear fulcrum of FIG. 4 and the front fulcrum of FIG. 10 can be combined.

Figure 13:
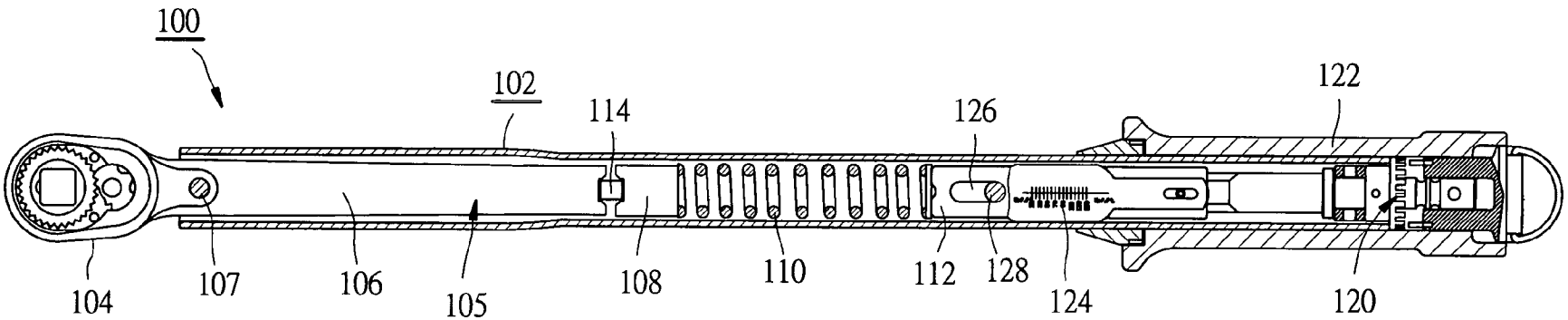
FIG. 13 is a longitudinal sectional view of still another preferred embodiment of the present invention.
Figure 14:
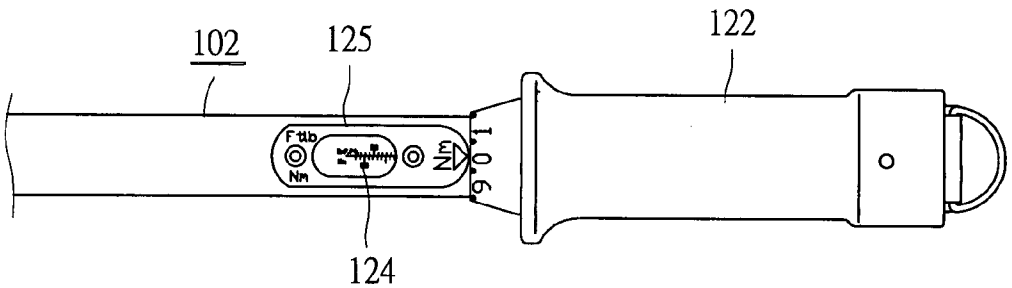
FIG. 14 is a partially top view of the embodiment of FIG. 13.

FIGS. 13 and 14 show still another embodiment of the torque wrench 100 of the present invention, which is a mechanical torque wrench.

The wrench has a tubular body 102, a head section 104 and a flexible mechanism 105. The flexible mechanism 105 includes a flexible bar 106, a push block 108, a resilient member 110 and a slide block 112. The front end of the flexible bar 106 is integrally connected with the rear end of the head section 104. An insertion pin 107 is inserted through the front end of the flexible bar 106 and the front end of the tubular body 102 to serve as a fulcrum. Accordingly, the flexible bar 106 and the head section 104 can swing about the insertion pin 107. The push block 108, resilient member 110 and slide block 112 are sequentially mounted in the tubular body 102 from front end to rear end. A block body 114 is positioned between the opposite faces of the push block 108 and the flexible bar 106 to contact therewith. An adjustment mechanism 120 is installed in the rear end of the tubular body 102 and connected with rear side of the slide block 112. A handle 122 is fitted around the rear end of the tubular body 102.

When rotating the handle 122, the adjustment mechanism 120 drives the slide block 112 to move along the axis of the tubular body for adjusting the resilient energy of the resilient member 110 abutting against the push block 108. The slide block is marked with scales 124. The tubular body is formed with a window 125 for seeing the scales to know the set torque value.

Figure 15:
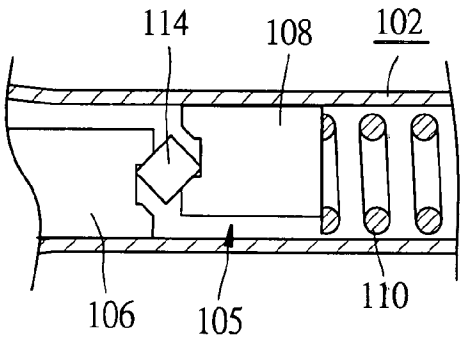
FIG. 15 shows that the embodiment of FIG. 13 is flexed.

When the wrenching torque of the wrench is greater than the set value, the flexible section of the flexible mechanism 105 will slip off. That is, as shown in FIG. 15, the rear end of the flexible bar 106 and the push block 108 will laterally slip to emit a sound as an alarm.

The slide block 112 is further formed with a longitudinal slide slot 126. An insertion pin 128 is inserted through the tubular body 102 and the slide slot 126 of the slide block. Accordingly, the insertion pin 128 serves as a rear fulcrum, while the insertion pin 107 serves as a front fulcrum. When a force is applied to the wrench, the flexible mechanism 105 is flexed about the two fulcrums. Therefore, the action force at the force application end (the handle) is equal to the action force at the resistance end (head section).

Furthermore, the flexible section of the flexible mechanism 120 is positioned between the two fulcrums so that the actual wrenching torque can be accurately and truly reflected. Accordingly, the set torque value will conform to the actual wrenching force.

The above embodiments are only used to illustrate the present invention, not intended to limit the scope thereof. Many modifications of the above embodiments can be made without departing from the spirit of the present invention.

What is claimed is:

1. A double-fulcrum torque wrench comprising:

a tubular body;

a head section for fitting with a socket or a screwing member; and a flexible mechanism including a flexible section, the flexible mechanism being connected with a rear end of the head section and disposed in the tubular body, the head section protruding from a front end of the tubular body, whereby when a wrenching force is applied to the wrench, the flexible section of the flexible mechanism is flexible;

said torque wrench being characterized in that the head section and the flexible mechanism are connected with the tubular body via two fulcrums and the flexible section is positioned between the two fulcrums;

wherein the flexible mechanism includes a flexible bar serving as the flexible section, a front end and a rear end of the flexible bar being respectively connected with the tubular body via the two fulcrums being designated as a front fulcrum and a rear fulcrum respectively;

wherein two support pins are respectively disposed on two sides of the front end of the flexible bar, the support pins abutting against an inner wall of the tubular body and serving as the front fulcrum.

2. The torque wrench as claimed in claim 1, wherein at least one insertion pin is inserted through the rear end of the flexible bar and the tubular body to serve as the rear fulcrum.

3. The torque wrench as claimed in claim 1, wherein two support pins are respectively disposed on two sides of the rear end of the flexible bar, the support pins abutting against the inner wall of the tubular body to serve as the rear fulcrum.

4. The torque wrench as claimed in claim 1, wherein the rear end of the flexible bar is connected with a jacket with larger width, the jacket being tightly fitted in the tubular body to serve as the rear fulcrum.

5. The torque wrench as claimed in claim 1, wherein the rear end of the flexible bar is connected with a jacket with larger width; at least one insertion pin is inserted through the tubular body and the jacket to serve as the rear fulcrum.

6. The torque wrench as claimed in claim 5, wherein the front end of the jacket being formed with an insertion hole; the rear end of the flexible bar is tightly inserted in the insertion hole.

7. A double-fulcrum torque wrench comprising:

a tubular body;

a head section for fitting with a socket or a screwing member; and a flexible mechanism including a flexible section, the flexible mechanism being connected with a rear end of the head section and disposed in the tubular body, the head section protruding from a front end of the tubular body, whereby when a wrenching force is applied to the wrench, the flexible section of the flexible mechanism is flexible;

said torque wrench being characterized in that the head section and the flexible mechanism are connected with the tubular body via two fulcrums and the flexible section is positioned between the two fulcrums;

wherein the flexible mechanism includes a flexible bar serving as the flexible section, a front end and a rear end of the flexible bar being respectively connected with the tubular body via the two fulcrums being designated as a front fulcrum and a rear fulcrum respectively;

wherein two support pins are respectively disposed on two sides of the rear end of the flexible bar, the support pins abutting against an inner wall of the tubular body and serving as the rear fulcrum.

8. The torque wrench as claimed in claim 7, wherein at least one insertion pin is inserted through the front end of the flexible bar and the tubular body to serve as the front fulcrum.

9. The torque wrench as claimed in claim 7, wherein the rear end of the flexible bar is connected with the tubular body via a fulcrum and the rear end of the head section is fixedly connected with the front end of the tubular body to serve as the front fulcrum.

10. The torque wrench as claimed in claim 9, wherein at least one insertion pin is inserted through the rear end of the head section and the tubular body to connect the head section with the tubular body.

* * * * *